US008069836B2

(12) United States Patent
Ehresman

(10) Patent No.: US 8,069,836 B2
(45) Date of Patent: Dec. 6, 2011

(54) FUEL INJECTION STREAM PARALLEL OPPOSED MULTIPLE ELECTRODE SPARK GAP FOR FUEL INJECTOR

(75) Inventor: Thomas Emanuel Ehresman, Loveland, CO (US)

(73) Assignee: Point-man Aeronautics, LLC, Loveland, CO (US)

( * ) Notice: Subject to any disclaimer, the term of this patent is extended or adjusted under 35 U.S.C. 154(b) by 295 days.

(21) Appl. No.: 12/381,623

(22) Filed: Mar. 11, 2009

(65) Prior Publication Data

US 2010/0229827 A1 Sep. 16, 2010

(51) Int. Cl.
*F02M 57/06* (2006.01)

(52) U.S. Cl. ..... 123/297; 123/151; 123/152; 123/169 V

(58) Field of Classification Search ..... 123/297, 123/151, 152, 169 V
See application file for complete search history.

(56) References Cited

U.S. PATENT DOCUMENTS

| | | | | | |
|---|---|---|---|---|---|
| 2,144,861 | A | | 1/1939 | Truxell, Jr. | |
| 2,795,214 | A | * | 6/1957 | Shook, II | 123/297 |
| 3,006,556 | A | | 10/1961 | Shade | |
| 3,777,977 | A | | 12/1973 | Regneault et al. | |
| 3,982,693 | A | | 9/1976 | Hulsing | |
| 4,046,112 | A | | 9/1977 | Deckard | |
| 4,129,253 | A | | 12/1978 | Bader, Jr. et al. | |
| 4,129,254 | A | | 12/1978 | Bader, Jr. et al. | |
| 4,129,255 | A | | 12/1978 | Bader, Jr. et al. | |
| 4,129,256 | A | | 12/1978 | Bader, Jr. et al. | |
| 4,317,541 | A | | 3/1982 | Beardmore | |
| 4,343,272 | A | * | 8/1982 | Buck | 123/297 |
| 4,392,612 | A | | 7/1983 | Deckard et al. | |
| 4,864,989 | A | * | 9/1989 | Markley | 123/267 |
| 4,967,708 | A | * | 11/1990 | Linder et al. | 123/297 |
| 5,377,633 | A | | 1/1995 | Wakeman | |
| 5,531,199 | A | | 7/1996 | Bryant et al. | |
| 5,628,293 | A | | 5/1997 | Gibson et al. | |
| 5,715,788 | A | | 2/1998 | Tarr et al. | |
| 6,135,084 | A | | 10/2000 | Corneer | |
| 6,340,015 | B1 | * | 1/2002 | Benedikt et al. | 123/297 |
| 6,359,377 | B1 | | 3/2002 | Durling | |
| 6,469,424 | B1 | * | 10/2002 | Marable | 313/120 |
| 6,612,539 | B1 | | 9/2003 | Ruehle et al. | |
| 6,748,918 | B2 | * | 6/2004 | Rieger et al. | 123/297 |
| 6,755,175 | B1 | * | 6/2004 | McKay et al. | 123/297 |
| 6,871,630 | B2 | * | 3/2005 | Herden et al. | 123/297 |
| 7,077,100 | B2 | * | 7/2006 | Vogel et al. | 123/297 |
| 7,131,423 | B2 | * | 11/2006 | Ehresman | 123/297 |
| 7,578,279 | B2 | * | 8/2009 | Ehresman | 123/297 |
| 2004/0112328 | A1 | * | 6/2004 | Herden et al. | 123/297 |
| 2006/0022554 | A1 | | 2/2006 | Mennicken | |
| 2008/0072871 | A1 | * | 3/2008 | Vogel et al. | 123/297 |

OTHER PUBLICATIONS

PCT Patent Application No. PCT/US2005/035555, filed Oct. 3, 2005, entitled "Fuel Injection Spark Ignition System".
U.S. Appl. No. 10/960,854, filed Oct. 6, 2004, entitled "Fuel Injection Spark Ignition System".
U.S. Appl. No. 11/664,709, filed Apr. 4, 2007, entitled "Fuel Injection Spark Ignition System".

* cited by examiner

*Primary Examiner* — Erick Solis
(74) *Attorney, Agent, or Firm* — Craig R. Miles; CR Miles, P.C.

(57) ABSTRACT

Generally, a multiple electrode spark gap fuel injector and methods of utilizing a multiple electrode spark gap fuel injector for internal combustion engines. Specifically, at least one pair of electrodes having a corresponding pair of electrode ends radially located and axially located in relation to an amount of dispersed fuel to increase efficiency of fuel combustion.

12 Claims, 7 Drawing Sheets

FUEL INJECTION STREAM PARALLEL OPPOSED MULTIPLE ELECTRODE SPARK GAP FOR FUEL INJECTOR

I. BACKGROUND

Generally, a multiple electrode spark gap fuel injector and methods of utilizing a multiple electrode spark gap fuel injector for internal combustion engines. Specifically, at least one pair of electrodes having a corresponding pair of electrode ends radially located and axially located in relation to an amount of dispersed fuel to increase efficiency of fuel combustion.

Fuel injectors convert fuel into a fine spray which is mixed with air in engine combustion chambers. The major advantage of the system is that the amount of fuel being mixed with air can be more precisely controlled and the mixture can be more evenly spread throughout the air coming into the engine. In combination with an electronic computer which monitors engine conditions and exhaust emissions, fuel injection can increase fuel efficiency and reduce pollution.

Fuel injection was adapted for use in petrol-powered aircraft during World War II and was first used in a car in 1955 with the introduction of the Mercedes-Benz 300SL Fuel injection became widespread with the introduction of electronically controlled fuel injection systems in the 1980s and the gradual tightening of emissions and fuel economy laws.

Today, fuel injection is conventionally used in diesel engines. The diesel engine is a type of internal combustion engine; more specifically, a compression ignition engine, in which the fuel is ignited by the high temperature of a compressed gas, rather than a separate source of energy, such as a spark plug. Many modern diesel engines use direct injection, in which the injection nozzle is located inside the combustion chamber. Today automobile manufacturers conventionally use fuel injection with gasoline engines.

A commonly used injector utilizes a closed-needle injector having a needle valve assembly which utilizes a spring-biased needle positioned adjacent to the orifice of a fuel metering chamber. The needle reciprocally operates to open and close communication between a fuel metering chamber and the engine combustion chamber allowing fuel to be injected into the cylinder and resisting blow back of exhaust gas into the fuel metering chamber of the injector. In many fuel systems, when the pressure of the fuel within the fuel metering chamber exceeds the biasing force of the needle spring, the needle moves outwardly to allow fuel to pass through the orifice(s) of the fuel metering chamber, thus marking the beginning of injection.

In another type of system disclosed by U.S. Pat. No. 5,676,114 to Tarr et al., the beginning of injection is controlled by a servo-controlled needle. The assembly includes a control volume positioned adjacent an outer end of the needle valve, a drain circuit for draining fuel from the control volume to a low pressure drain, and an injection control valve positioned along the drain circuit for controlling the flow of fuel through the drain circuit so as to cause the movement of the needle valve element between open and closed positions. Opening of the injection control valve causes a reduction in the fuel pressure in the control volume resulting in a pressure differential which forces the needle valve open, and closing of the injection control valve causes an increase in the control volume pressure and closing of the needle valve. U.S. Pat. No. 5,463,996 issued to Maley et al. discloses a similar servo-controlled needle valve injector.

U.S. Pat. No. 5,458,292 to Hapeman discloses a fuel injector with inner and outer injector needle valves biased to close respective orifices and operable to open at different fuel pressures. The inner needle valve is reciprocally mounted in a central bore formed in the outer needle valve. However, the opening of each needle valve is controlled solely by injection fuel pressure acting on the needle valve in the opening direction such that the valves necessarily open when the injection fuel pressure reaches a predetermined level.

United Kingdom Patent Application No. 2266559 to Hlousek discloses a closed needle injector assembly including a hollow needle valve for cooperating with one valve seat formed on an injector body to provide a main injection through all the injector orifices and an inner valve needle reciprocally mounted in the hollow needle for creating a pre-injection through a few of the injector orifices.

U.S. Pat. No. 5,199,398 to Nylund discloses a fuel injection valve arrangement for injecting two different types of fuels into an engine which includes inner and outer poppet type needle valves. During each injection event, the inner needle valve opens a first set of orifices to provide a pre-injection and the outer needle valve opens a second set of orifices to provide a subsequent main injection. The outer poppet valve is a cylindrical sleeve positioned around a stationary valve housing containing the inner poppet valve.

U.S. Pat. No. 5,899,389 to Pataki et al. discloses a fuel injector assembly including two biased valve elements controlling respective orifices for sequential operation during an injection event. A single control volume may be provided at the outer ends of the elements for receiving biasing fluid to create biasing forces on the elements for opposing the fuel pressure opening forces. However, the control volume functions in the same manner as biasing springs to place continuous biasing forces on the valve elements. As a result, the needle valve elements only lift when the supply fuel pressure in the needle cavity is increased in preparation of a fuel injection event to create pressure forces greater than the closing forces imparted by the control volume pressure.

Other types of injectors may coupled to a fuel supply which delivers fuel to a pump chamber within the fuel injector at a predetermined supply pressure, this pressure then being increased within the fuel injector to a higher injection pressure to effect actuation of the needle valve assembly. A commonly used means to increase pressure within the storage chamber includes plunger which reciprocates within the pump chamber which is actuated by an engine driven cam or other reciprocating means. Fuel in the pump chamber is delivered to the fuel metering chamber at a pressure sufficiently high to move the needle from the valve seat.

In one form of such a fuel injector, the plunger is provided with helices which cooperate with suitable ports in the pump chamber to control the pressurization and therefore the injection of fuel during a pump stroke of the plunger.

In another form of such a fuel injector, a solenoid valve is incorporated in the fuel injector so as to control, for example, the drainage of fuel from the pump chamber. In this latter type injector, fuel injection is controlled by energizing the solenoid valve. An exemplary embodiment of such an electromagnetic fuel injector is disclosed, for example, in U.S. Pat. No. 4,129,253 to Ernest Bader, Jr., John I. Deckard and Dan B. Kuiper.

Other types of fuel injection systems may use piezoelectric actuators or elements, in which the piezoelectric actuators or elements exhibit a proportional relationship between an applied voltage and a linear expansion. Thus, it is believed that using piezoelectric elements as actuators may be advantageous in fuel injection nozzles for internal combustion engines as disclosed by European Patent Specifications EP 0 371 469 B1 and EP 0 379 182 B1.

An example of a fuel injector which uses the expansion and contraction of piezoelectric elements with double-acting, double-seat valves to control corresponding injection needles in a fuel injection system is shown by German Patent Applications DE 197 42 073 A1 and DE 197 29 844 A1.

As can be understood from the above discussion, there is a large commercial market for fuel injectors for use in various types of reciprocating, rotary and other types of engines which has wide application in automotive and aircraft industries with respect to both compression ignition and spark ignition engines.

First, with respect to compression ignition engines, there is a compelling argument for stronger penetration in the market as a means of reducing $CO_2$ emissions. With the focus of the Kyoto Protocol on emissions of greenhouse gases, and the contribution of transportation sources to this problem. Moreover, compression ignition engines are able to extract almost double the useful work than conventional spark ignition engines.

However, while compression ignition is an attractive solution for CO2 reduction, exhaust emissions associated with diesel fuel are increasingly coming under the environmental spotlight. Most notable are the oxides of nitrogen (NOx) and particulate matter (PM), which are regarded almost exclusively as "diesel problems". The difficulty in meeting the increasingly stringent limitations on particulate and NOx emissions has stimulated interest in ethanol-fueled compression ignition engines because ethanol diffusion flames produce virtually no soot. Unfortunately ethanol does not have suitable ignition properties under typical diesel conditions because the temperatures and pressures characteristic of the diesel engines causes a longer ignition delay while using ethanol. Therefore, in order to make use of ethanol in a diesel engine, either a system to improve the ignition quality of ethanol or an ignition aid may be necessary.

Similarly, compression ignition engines can be operated with fuels made from other organic stock such as soybeans, rapeseed, and animal tallow produced through a process called transesterification which removes fatty particulates that cause coking and other problems in diesel engines. These additional bio-fuels used undiluted or mixed with diesel fuel have demonstrated reduced particulate emission. However, as the concentration of bio-fuel is increased cold engine start may require additional engine cranking and cold engine operation may be substantially inferior to diesel fuel. Similarly, in order to make use of bio-fuels either a system to improve the ignition quality of bio-fuels or an ignition aid may be necessary.

Second, with respect to lower compression spark ignition engines, the composition of fuels and the manner of operation, especially in automobiles, has significantly altered over the past thirty years. To meet air pollution regulations in the United States, and in other countries, the lead in gasoline was removed substantially lowering octane of the fuel. To compensate for the lowered octane, automobile manufacturers altered the timing in cars to prevent the resulting "ping" or "knock" and to reduce NOx formed at higher combustion temperatures and pressure.

In spark ignition engines, as you retard timing from top dead center, both peak combustion temperatures and peak cylinder pressures go down (as does "knock" and the production of NOx). At some point, however, spark ignition comes too early and the pressure produced from combustion works against the piston (on the up stroke) more than it works with the piston (on the down stroke).

In newer vehicles, how much fuel to deliver to the fuel combustion cylinder and when to provide ignition spark is typically monitored by computers which use sensors to detect engine "ping" or "knock" and to reduce emissions; however, the amount of ignition control that can be achieved under a broad range of operating conditions may be insufficient to completely eliminate "ping" or "knock" under certain circumstances, for example when low octane fuel is used. Also, the computer may be reacting to something that is already happening or has happened, and engine "ping" or "knock" has the potential to be harmful with relatively few occurrences.

Third, aviation remains the only transportation industry in the United States whose engine emissions are not yet regulated. The piston engine fleet uses the only fuel still containing lead as an octane enhancer. While turbine engine manufacturers have dedicated considerable resources to reduce engine emissions, the airline industry has experienced unprecedented growth and the aggregate pollution has increased dramatically. In addition to the problem caused locally by pollutants, fossil fuels used in aircraft worldwide have a significant impact on global warming because of the altitude at which they are emitted. Therefore, there are two pending crises in the aviation world: 1. the mounting pressure to remove lead from the aviation gasoline used by the piston engine fleet, and 2. the commercial aviation's environmental impact escalating both at the local and global level.

With the removal of lead from aviation fuel, use of the resulting lower octane fuel will require technical innovations to avoid "ping" and "knock". Because existing technology may not allow sufficient ignition control to eliminate "ping" and "knock" under certain circumstances and aircraft engines may then experience increased wear similar to that experienced in automobile engines using lower octane fuels.

Also, the Federal Aviation Administration has provided certifications for engines and aircraft powered by ethanol. Supplemental Type Certificates have also been issued for the use of 100% denatured ethanol for the 10-540 series of 260 HP Lycoming engines, for the 0-235 series of Lycoming engines, and the Cessna 152 series of training aircraft. In May of 2000, dual fuel certification was obtained for a Piper Pawnee, an agricultural spray aircraft for the use of either ethanol or Avgas.

While aviation applications of bio-fuels are economically competitive with aviation fossil fuels, and are actually less expensive if the real cost of the fossil fuels is taken into account, the use of bio-fuels may be limited due to reduced performance of aviation engines under certain conditions as above-described and may require an ignition aid.

The instant invention can address certain aspects of the problems encountered by the use of lower octane or bio-fuels in fuel injected spark ignition engines.

II. SUMMARY OF THE INVENTION

Accordingly, a broad object of the invention can be to provide a fuel injector which further includes at least one pair of conductors having a corresponding pair of conductor ends radially located and axially located in relation to an amount of fuel dispersed from the fuel injector nozzle to increase efficiency of ignition and fuel combustion upon discharge of an electrically current across the gap established between a first conductor end and a second conductor end.

Another broad object of the invention can be to provide a fuel injector which further includes at least one pair of conductors having a corresponding pair of conductor ends radially and axially located proximate a fuel dispersion boundary of a fuel dispersion pattern of an amount of fuel dispersed from the fuel injector nozzle to increase efficiency of ignition and fuel combustion upon discharge of an electrically current across the gap established between a first conductor end and a second conductor end.

Another broad object of the invention can be to provide a fuel injector which further includes at least one pair of conductors having a corresponding pair of conductor ends with the first of the pair of conductors and the second of the pair of conductors aligned radially about the longitudinal axis of the injector nozzle with the first of the pair of conductor ends disposed closer to the nozzle of the fuel injector than the second of the pair of conductor ends to increase efficiency of ignition and fuel combustion upon discharge of an electrically current across the gap established between a first conductor end and a second conductor end.

Another broad object of the invention can be to provide a fuel injector which further includes at least two pair of conductors having a corresponding at least two pair of conductor ends with the first of the pair of conductor ends disposed in substantially oppose relation radially about the longitudinal axis of the nozzle of the fuel injector, and in addition as to other embodiments, locating the first pair of conductor ends proximate the nozzle and the second pair of conductor ends distal from the nozzle, and in addition as to other embodiments, locating a first of each pair of conductor ends proximate the nozzle and a second of each pair of conductor ends distal from the nozzle, and in addition as to other embodiments, locating each conductor end proximate the fuel dispersion boundary of the fuel injection pattern of the amount of fuel dispersed from the nozzle of the fuel injector, each embodiment configured to increase efficiency of ignition and fuel combustion upon discharge of an electrically current across the gap established between a first conductor end and a second conductor end.

Naturally, further objects of the invention are disclosed throughout other areas of the specification and drawings.

III. A BRIEF DESCRIPTION OF THE DRAWINGS

IV. DETAILED DESCRIPTION OF THE PREFERRED EMBODIMENTS

Generally, a multiple electrode spark gap fuel injector and methods of utilizing a multiple electrode spark gap fuel injector for internal combustion engines. Specifically, at least one pair of electrodes having a corresponding pair of electrode ends radially located and axially located in relation to an amount of dispersed fuel to increase efficiency of fuel combustion.

Figure 1:
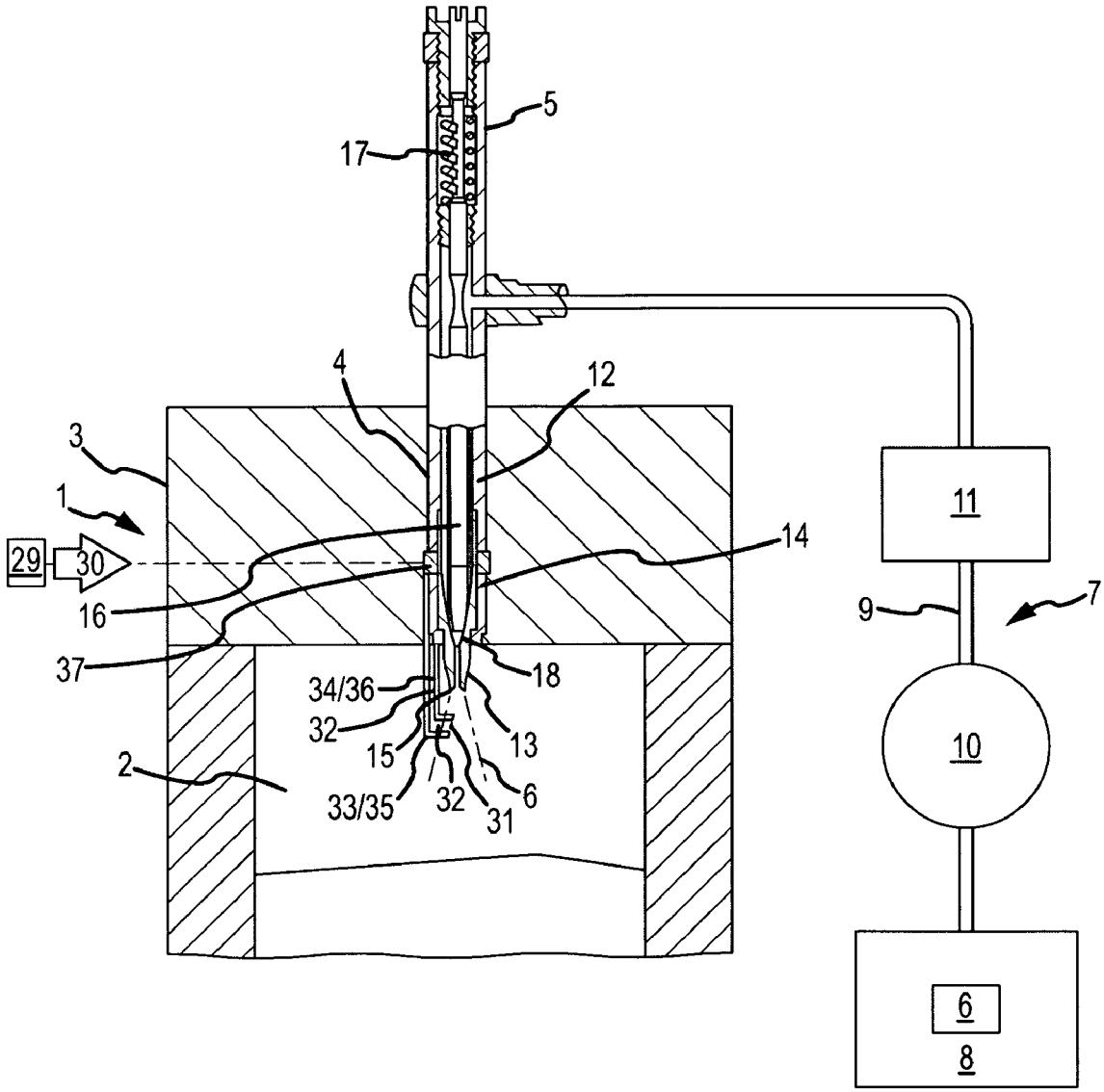
FIG. 1 shows an embodiment of the fuel injection spark ignition invention which operates to ignite fuel in a fuel combustion cylinder.

Now referring primarily to FIG. 1, an exemplary engine and fuel injection system in accordance with the invention is shown. An engine (1) may contain one or more fuel combustion chambers (2). The engine (1) can have at least one cylinder head (3) having a fuel injector bore (4) which communicates with each fuel combustion chamber (2). A fuel injector (5) fits or can be adapted to fit in each fuel injector bore (4).

A fuel system (7) provides a fuel source (8), such as a fuel tank, and a fuel passage (9) which communicates between the fuel source (8) and the fuel injector (5). A fuel transfer means (10), such as a fuel pump, delivers an amount of fuel (6) from the fuel source (8) through the fuel passage (9) to the fuel injector (5). With respect to certain embodiments of the invention, a fuel return passage (not shown in the figure) may communicate between the fuel injector (5) and the fuel supply (8). The cylinder head (3) can be configured to define a portion of the fuel passage (9) or a portion of the fuel return passage, or both, as to certain embodiments of the invention. One or more fuel filters (11) may be can be arranged in fluid communication between the fuel source (8) and the fuel injector(s) (5).

It should be understood that the above description of the engine and fuel injection system is not intended to be limiting with regard to the scope of the invention, but rather is intended to provide a general example of the numerous and varied configurations of internal combustion engines, whether diesel, spark ignition, rotary engines, turbine, modified cycle engines, or the like, that may be used in aircraft, automobiles, motorcycles, snowmobiles, lawnmowers, or otherwise, that can be operated utilizing certain embodiments of the invention.

Similarly, while FIG. 1 shows an exemplary fuel injector (5), it is not intended that the type of fuel injector (5) shown be limiting with regard the scope of the invention, but rather illustrative of the numerous and varied types of fuel injectors (5) having components which can be used or modified for use in accordance with the invention. Specifically without limitation, fuel injectors (5) such as those manufactured by Rossa-Master, Cummins, or other fuel injectors as above-discussed, or the like, may have parts that may be modified or have parts that may be useful when operated in accordance with the invention.

Again referring primarily to FIG. 1, in a preferred embodiment of the invention, the fuel injector (5) comprises a fuel injector body (12) and a nozzle (13). The nozzle (13) defines the configuration of a nozzle chamber (14) having a fuel injection orifice (15). The nozzle (13) can have one fuel injection orifice (15) as shown: however, as to certain embodiments of the nozzle (13) can have two or more fuel injection orifices (15) through which an amount of fuel (6) can be dispersed. The fuel supply passage (9) communicates with the nozzle chamber (14) and the fuel injection orifice (15) communicates with one of the fuel combustion chambers (2).

An injector valve (16) or valve means operates to open and close communication between the nozzle chamber (14) and the corresponding one of the fuel combustion chambers (2). As to certain embodiments of the invention as shown by the non-limiting example of FIG. 1, the injector valve (16) operates in response to fuel pressure within the nozzle chamber (14). When the fuel pressure in the nozzle chamber (14) becomes sufficient to overcome the force applied to the injector valve (16) by the coil spring (17), the injector valve (16) is lifted off its valve seat (18) and the amount of fuel (6) is forced through one or more fuel injection orifices (15) into the corresponding one of the fuel combustion chambers (2). A check valve (not shown in FIG. 1) can be mounted in the nozzle chamber (14) to prevent the amount of fuel (6) in the corresponding one of the fuel combustion chambers (2) from flowing back into the nozzle chamber (14).

Figure 2:
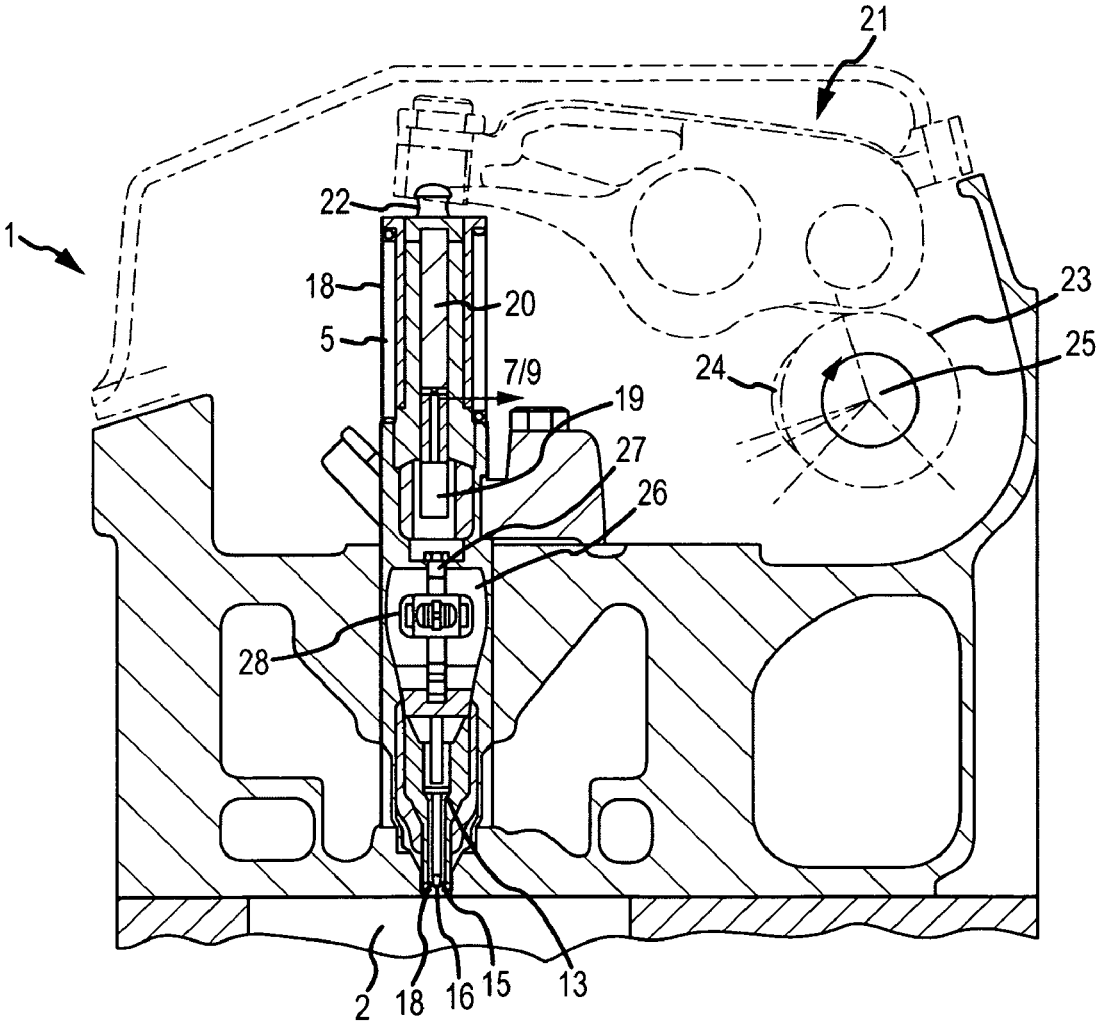
FIG. 2 shows an embodiment of the fuel injection spark ignition invention which further includes fuel pressurization means located within the fuel injector.

Now referring primarily to FIGS. 1 and 2, an amount of fuel (6) can be delivered from the fuel source (8) by the fuel transfer means (10) at sufficient pressure to lift the injector valve (16) from the corresponding valve seat (18). Typically, constructional forms of the fuel transfer means (10) delivers fuel at insufficient pressure to lift the injector valve (16) from the corresponding valve seat (18). Therefore, a fuel pressure generator (see FIG. 2) disposed within the fuel injector (5) operates to increase pressure of an amount of fuel (6) within the nozzle chamber (14) to a level sufficient to lift the injector valve (16) from the corresponding valve seat (8).

One non-limiting mechanism for increasing fuel pressure delivered to the nozzle chamber (14) is shown in FIG. 2. In that particular embodiment of the invention, a fuel storage chamber (19) communicates with the fuel supply passage (9). A plunger (20) actuatable from a location outside of the fuel injector (5) moves within the fuel storage chamber (19) to pressurize an amount of fuel (6). The plunger (20) actuating means (21) may be any of a variety of mechanical actuating device or hydraulic actuating device. In the embodiment shown, a tappet (22) and plunger (20) assembly is actuated indirectly or directly by a rotatable cam (23) or cam lobe (24) mounted on an engine (1) driven cam shaft (25). The profile of the surface of the rotatable cam (23) times plunger (20) movement, plunger stroke, and range of fuel pressures. A fuel control passage (26) communicates between the fuel storage chamber (19) and the nozzle chamber (13). One or more valve means (27) operates to open and close communication between the fuel storage chamber (19) and the nozzle chamber (13). Electrical actuation means (28) can be provided to operate the one or more valve means (27). For example, the electrical actuation means (28) can include a single solenoid or a plurality of solenoids. The one or more valve means (27) operate to deliver pressurized fuel (6) to the nozzle chamber (13) lifting the injector valve (16) from the corresponding valve seat (18) allowing the amount of fuel (6) to be dispersed into one of the fuel combustion chambers (2) through the nozzle orifice (15).

Again referring primarily to FIG. 1, the inventive fuel injector (5) can further include an electric current generator (29) which generates an electrical current (30) timed in relation to the delivery of the amount of fuel (6) from the nozzle orifice (15) into the corresponding one of the fuel combustion chambers (2). The delivery of the amount of fuel (6) from the nozzle orifice (15) of the nozzle (13) of the fuel injector (5) can be timed in relation to the position of those parts of the engine (such as pistons coupled to a crankshaft) which translate the expansion of gases resulting from combustion of the amount of fuel (6) in the corresponding one of the combustion chambers (2) into rotational motion of the drive shaft (not shown). The electrical current (30) can be sufficient to generate a discharge (31) of electrical current (30) (or spark) across a gap (32) of at least a pair of conductors (33)(34) proximate a corresponding pair of conductor ends (35)(36) within the corresponding one of the combustion chambers (2) to ignite the amount of fuel (6) delivered from the nozzle (15) of the fuel injector (5).

The electric current generator (30) which functions to generate and time the discharge (31) (spark) of electrical current (30) (spark) across the gap (31) of the one or more pairs of conductors (33)(34) proximate the corresponding one or more pairs of conductor ends (35)(36), can take a conventional constructional form such as a magneto system in which the engine spins a magnet inside a coil, ignition coil and distributor, electronic ignition (whether analog or digital), engine management system, or the like. Certain embodiments of the electric current generator (29) can take the form of a piezoelectric element (37) or piezoelectric crystal located in whole or in part in the nozzle chamber (14) as described by U.S. Pat. No. 7,131,423, hereby incorporated by reference herein. The electric current generator (29) and the one or more pairs of conductors (33)(34) can be electrically isolated or insulated from the nozzle (13) and each other to prevent a short circuit of the electrical current (30) preventing a discharge (31) of the electrical current (30) across the gap (32) defined by location of the conductor ends (35)(36). The manner of electrically isolating the electric current generator (29) and the one or more pairs of conductors (33)(34) can vary between embodiments of the inventive fuel injector (5), as discussed in greater detail below.

Figure 3:
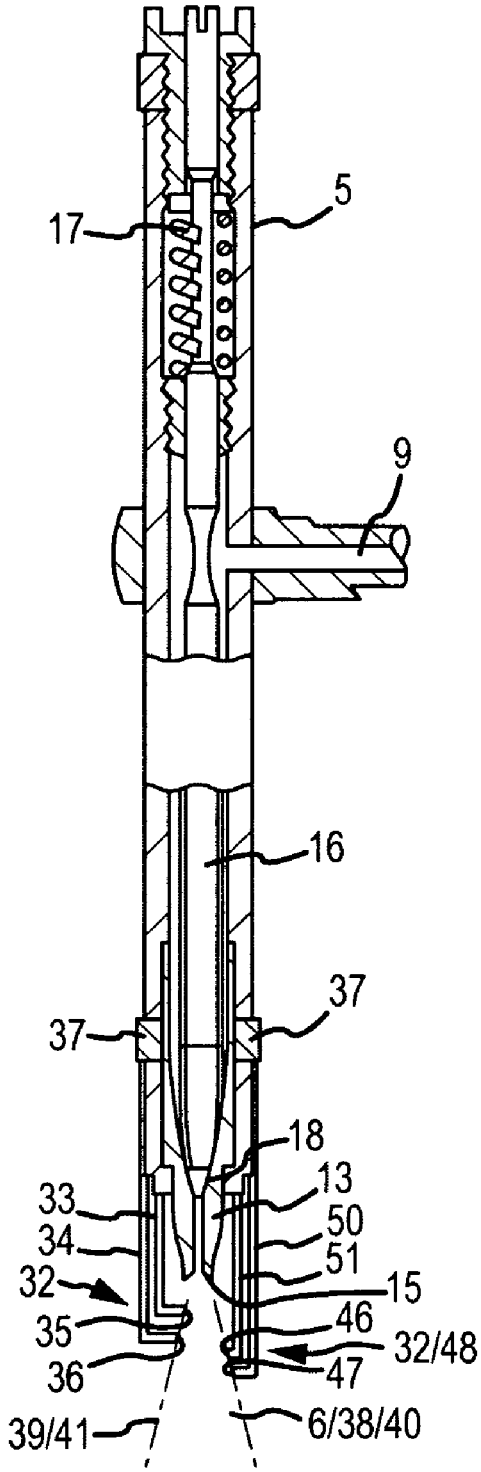
FIG. 3 shows an exemplary embodiment of the invention which provides a fuel injector having a piezoelectric element located in the nozzle chamber which generates an electric current in response to fuel pressure timely discharged across a gap to ignite fuel in the fuel combustion chamber.

Now referring primarily to FIG. 3, the amount of fuel (6) dispersed through the nozzle orifice (15) can have a fuel dispersion pattern (38). The fuel dispersion pattern (38), and the fuel injection boundary (39) it defines, can vary between the numerous and varied configurations of the nozzle (13) and nozzle orifice(s) (15) which can be utilized with the inventive fuel injector (5). While the fuel dispersion pattern (38) shown in the Figures has a substantially conical fuel dispersion pattern (40) which defines a conical fuel dispersion boundary (41); this is not intended to be limiting with respect to the numerous and varied fuel dispersion patterns (38) associated with a corresponding variety of fuel injector nozzles (15) and nozzle orifices which define a corresponding numerous and varied fuel dispersion boundaries (39).

The conical fuel dispersion pattern (40) shown in the Figures is intended to provide clarity with respect to certain embodiments of the invention which position or locate the conductor ends (35)(36) or the gap (32) established by the relation of the conductor ends (35)(36) in relation to the fuel dispersion pattern (40) to enhance ignition of the amount of fuel (6) injected into the corresponding one of the fuel injection chambers (2). The fuel dispersion pattern (38) and the fuel dispersion boundary (39) which the fuel dispersion pattern (38) defines can be assessed by a variety of methods such as Phase Doppler Analysis which utilizes the scattering of light by dispersed fuel particles, Particle Image Velocimetry and Particle Trajectory Velocimetry which graphically process the tracks of sprayed fuel particles, and the method for measuring tip velocity of sprayed fuels as described by U.S. Pat. No. 7,405,813, or the like. While each method may define the fuel dispersion boundary (39) of a given fuel dispersion pattern (38), somewhat differently, the fuel dispersion boundary (39) defined by each method can be suitable for use in positioning or locating the conductor ends (35)(36) with respect to the fuel dispersion pattern (38) for the purposes of locating a discharge (31) of the electrical current (30) across the gap (32) for certain embodiments of the invention further described below.

Figure 4:
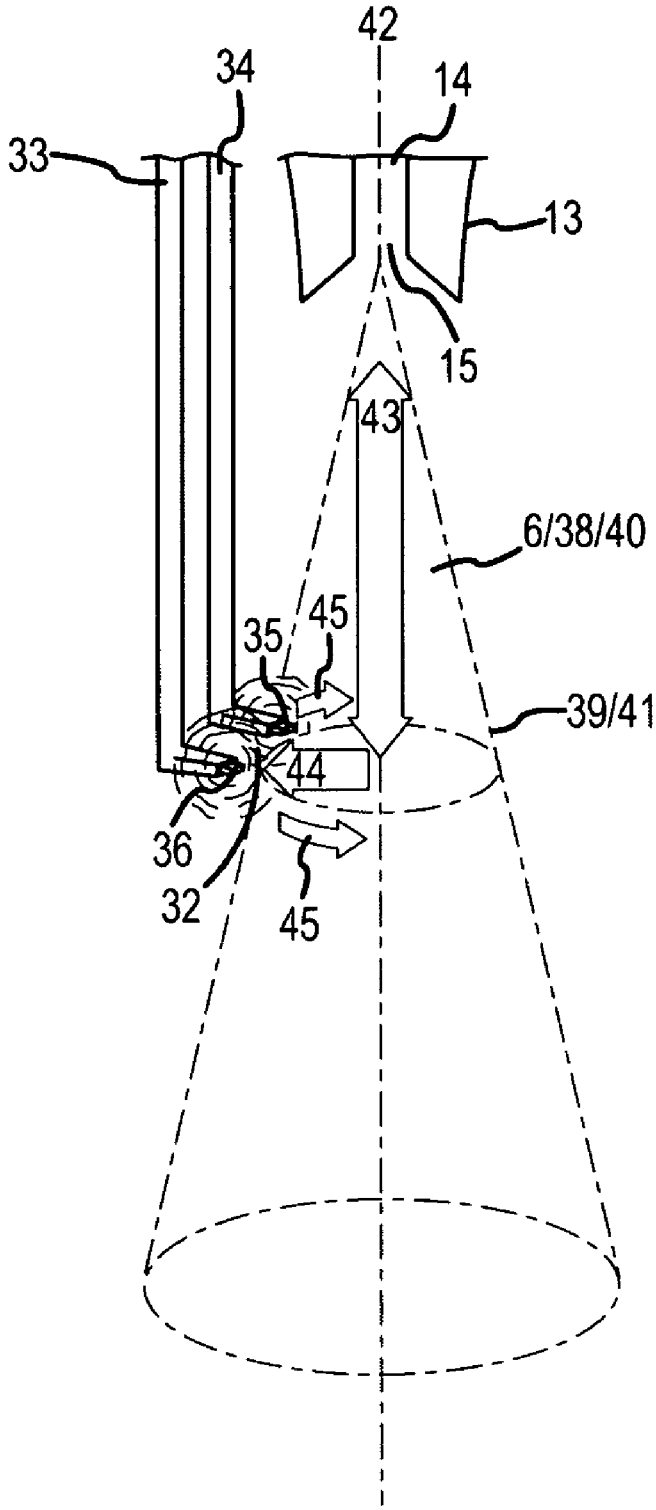
FIG. 4 is an illustration which provides an example of the relation of a pair of conductor ends axially with respect to the longitudinal axis of a fuel injector nozzle and radially outward from the longitudinal axis of the fuel injector nozzle and radially spaced about the longitudinal axis of the fuel injector nozzle.

Now referring to FIG. 4, as to certain embodiments of the inventive fuel injector (5), a first pair of conductors (33)(34) which terminate in a corresponding first pair of conductor ends (35)(36) can be disposed to generate a discharge (32) of an electrical current (30) across a first gap (32). The location of the corresponding first pair of conductor ends (35)(36) in relation to each other can be an important factor in increasing the efficiency in combusting the amount of fuel (6) dispersed from the nozzle orifice (15).

For clarity purposes, FIG. 4 provides an example which describes the relation of a pair of conductor ends (35)(36) of a particular embodiment of the invention. Each of the pair of conductor ends (35)(36) can be described as being axially located a distance from the nozzle orifice (15) in relation to the longitudinal axis (42) (see arrow identified with reference numeral (43) of the injector nozzle (13), and radially located a distance outwardly from the longitudinal axis (42) (see arrow identified with reference numeral (44), and spaced radially about the longitudinal axis (42) (see two arrows with reference numeral (45)). For example, the pair of conductor ends (35)(36) shown as an example in FIG. 4 are located substantially the same distance (43) from the nozzle orifice (15) along the longitudinal axis (42), radially located a distance (44) outwardly from the longitudinal axis (42), and spaced radially a distance (45) apart about the longitudinal axis (42) to establish a gap (32) between the pair of conductor ends (35)(36) across which a discharge (31) of the electrical current (30) can occur. Depending upon the location of the one or more pairs of conductor ends (35)(36), the gap (32) will be greater or lesser and the discharge (31) across the gap (32) will have different direction in relation to the fuel dispersion pattern (38) or the fuel dispersion boundary (39).

Figure 5A:
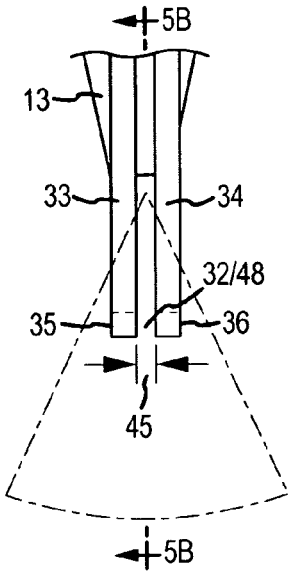
FIGS. 5A and 5B show a particular embodiment of the inventive fuel injector.
Figure 5B:
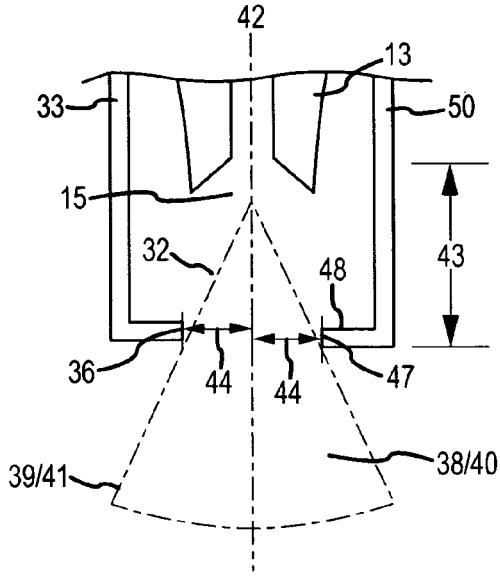

Now referring to FIG. 5A which shows side view and FIG. 5B which shows a front view (rotated 90° about the longitudinal axis (42) of the nozzle (13) of the fuel injector (5)) of a particular embodiment of the inventive fuel injector (5) having a first pair of conductor ends (35)(36) located at substantially the same distance (43) along the longitudinal axis (42) from the nozzle orifice (15), and radially located at substantially the same distance (44) outwardly from the longitudinal axis (42), and radially spaced a distance apart (45) about the longitudinal axis (42) to establish a gap (32) between the opposed external surfaces of the pair of conductor ends (35)(36) in a range of about one eighth inch and about three quarters inch; however, the gap (32) depending upon the application in which an embodiment of the invention is utilized can be greater or lesser than this range so long as a discharge (31) can occur between the pair of conductors (35)(36). As to certain embodiments, a second pair of conductors (50)(51) and a second pair conductor ends (46)(47) can be disposed in radial opposition (about 180°) to the first pair of conductor ends (35)(36) located at substantially the same distance along the longitudinal axis (42) of the nozzle (13) from the nozzle orifice (15)(43) and radially located at substantially the same distance outwardly from the longitudinal axis (42) of the nozzle (13)(44), and radially spaced at substantially the same distance apart about the longitudinal axis (42)(45) to establish a first gap (32) and a second gap (48) between the opposed external surfaces of the first pair of conductor ends (35)(36) and the second pair of conductor ends (46)(47) in a range of about one eighth inch and about three quarters inch. The above-described particular embodiment of the fuel injector (5) provides a first pair of conductor ends (35)(36) and the second pair of conductor ends (46)(47) in radially opposed relation about the longitudinal axis (42) of the nozzle (13) at the same distance (43) along the longitudinal axis (42) from the nozzle orifice (15). This particular embodiment of the inventive fuel injector (5) can further locate the first pair of conductor ends (35)(36) and the second pair of conductor ends (46)(47) a distance (44) outwardly from the longitudinal axis (42) of the nozzle (13) at about the fuel dispersion boundary (39)(in the example shown the conical fuel dispersion boundary (41)) of the fuel dispersion pattern (38)(in the example shown the conical fuel dispersion pattern (40)).

Figure 6A:
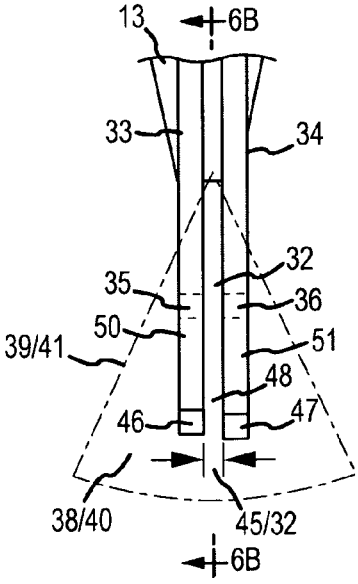
FIGS. 6A and 6B show another particular embodiment of the inventive fuel injector.
Figure 6B:
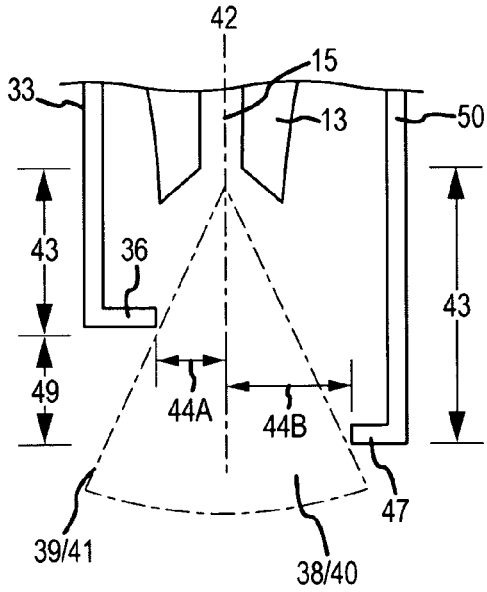

Now referring primarily to FIG. 6A which shows a side view and FIG. 6B which shows a front view (rotated 90° about the longitudinal axis (42) of the nozzle (13) of the fuel injector (5)) of a particular embodiment of the invention, the first pair of conductor ends (35)(36) and the second pair of conductor ends (46)(47) can be located as above described for the embodiment shown in FIG. 5A and FIG. 5B but can also locate the second pair of conductor ends (46)(47) a greater distance (43) from the nozzle orifice (15) along the longitudinal axis (42) (the difference in distance shown by arrow (49)). As to certain embodiments, where the first pair of conductor ends (35)(36) and the second pair of conductor ends (46)(47) have locations at different distances (43) from the nozzle orifice (15) along the longitudinal axis (42) and also have a location at about the fuel dispersion boundary (39) (in the example shown, the conical fuel dispersion boundary (41)), the distance radially outward (44B) from the longitudinal axis (42) of the distal second pair of conductor ends (46)(47) can be greater than the distance radially outward (44A) from the longitudinal axis of the proximate first pair of conductor ends (35)(36).

Figure 7A:
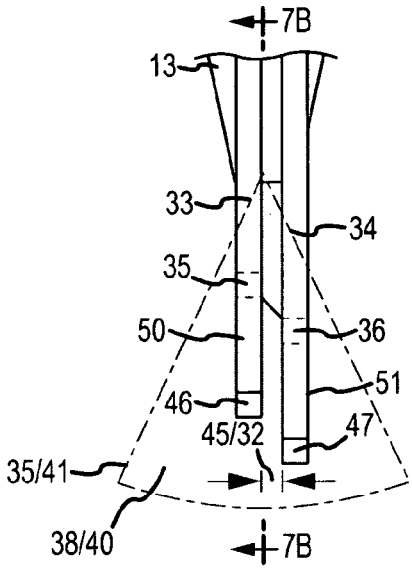
FIGS. 7A and 7B show another particular embodiment of the inventive fuel injector.
Figure 7B:
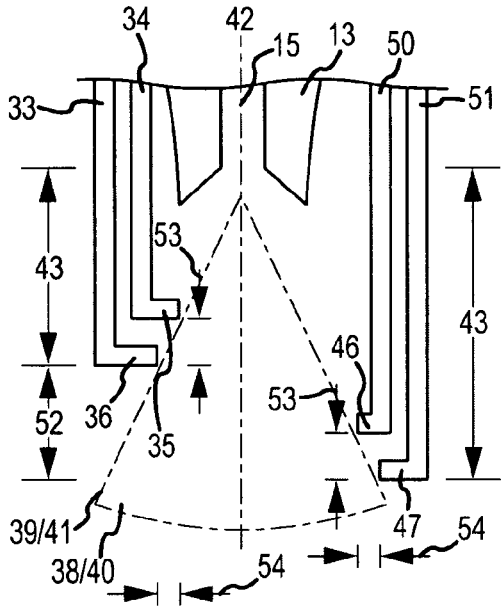

Now referring primarily to FIG. 7A and FIG. 7B, as to certain embodiments of the invention, the first pair of conductor ends (35)(36) and the second pair of conductor ends (46)(47) can be located similarly as described for the embodiment shown in FIG. 5A and FIG. 5B with the second pair of conductor ends (46)(47) a greater distance (43) from the nozzle orifice (15) along the longitudinal axis (42)(the difference in distance shown by arrow (52)). As to one or both of the first pair of conductor ends (35)(36) and the second pair of conductor ends (46)(47), a first conductor end (35)(46) or a second conductor end (36)(47) of each of the first pair of conductor ends (35)(36) and the second pair of conductor ends (46)(47) can also be located at a greater distance from the nozzle orifice (15)(the difference in distance is show by arrows (53)). The difference in the distance (43) along the longitudinal axis (42) between the first conductor end (35)(46) and the second conductor end (36)(47) can be in the range of about one eighth inch and about three quarters inch. However, a greater or lesser distance can utilized depending on the application.

As to certain embodiments, where the first conductor end (35)(46) and the second conductor end (36)(47) have locations at different distances (43) from the nozzle orifice (15) along the longitudinal axis (42) and also have a location at about the fuel dispersion boundary (39) (in the example shown, the conical fuel dispersion boundary (41)), the distance (44) radially outward from the longitudinal axis (42) of the distal second conductor end (36)(47) will be greater than the distance (44) radially outward from the longitudinal axis of the proximate first conductor end (35)(46) (the difference in distance shown as arrows (54)).

Figure 8A:
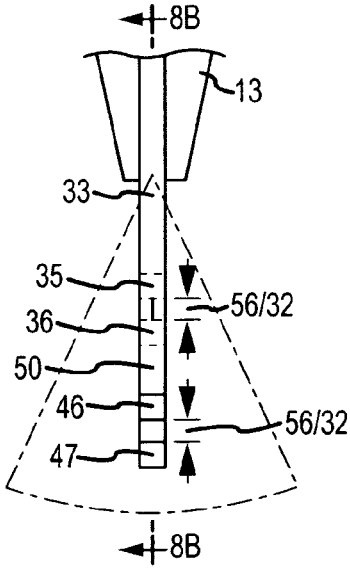
FIGS. 8A and 8B show another particular embodiment of the inventive fuel injector.
Figure 8B:
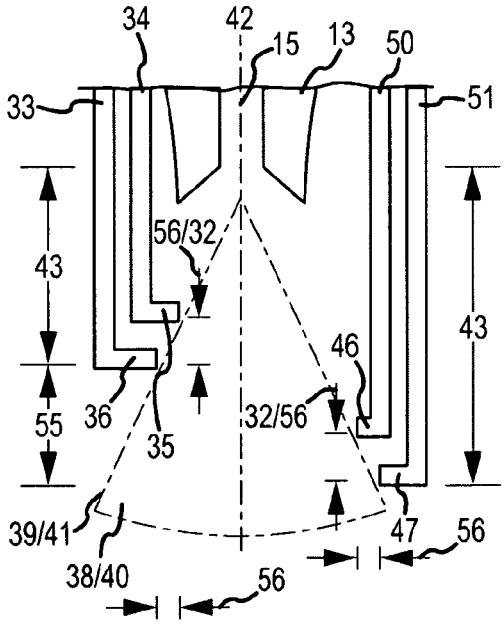

Now referring to FIGS. 8A and 8B, certain embodiments of the invention can locate the second pair of conductor ends (46)(47) a greater distance from the nozzle orifice (15) along the longitudinal axis (42) (the difference shown as arrow between brackets with reference numeral (55)). Additionally, as to one or both of the first pair of conductor ends (35)(36) and the second pair of conductor ends (46)(47), a first conductor end (35)(46) or a second conductor end (47)(36) can also be located at a greater distance from the nozzle orifice (15) (the difference shown as arrow between brackets with reference numeral (56). The difference in the distance along the longitudinal axis (42) between the first conductor end (35)(46) and the second conductor end (36)(47) can be in the range of about one eighth inch and about three quarters inch. Additionally, as to one or both of the first pair of conductor ends (35)(36) and the second pair of conductor ends (46)(47), a first conductor end (35)(46) or a second conductor end (36)(47) can also be located radially about the longitudinal axis (42) at the same location (resulting in the second conductor end (36)(47) being disposed directly beneath the first conductor end (35)(46). As to certain embodiments, where the first conductor end (35)(46) and the second conductor end (36)(47) have locations at different distances from the nozzle orifice (15) along the longitudinal axis (42) and also have a location at about the fuel dispersion boundary(39)(in the example shown, the conical fuel dispersion boundary (41)), the distance radially outward from the longitudinal axis of the distal second conductor end (36)(47) will be greater than the distance radially outward from the longitudinal axis (42) of the proximate first conductor end (35)(46) (the difference in distance shown by the arrow between brackets having reference numeral (56)).

Figure 9:
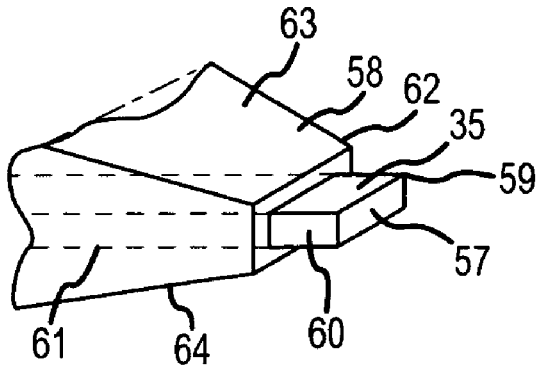
FIG. 9 shows a particular embodiment of an insulator coupled to one of a pair of conductors and a particular embodiment of a conductor end.
Figure 10:
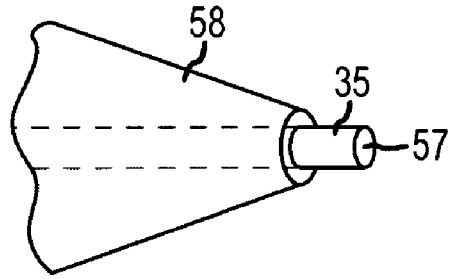
FIG. 10 shows a particular embodiment of an insulator coupled to one of a pair of conductors and a particular embodiment of a conductor end.
Figure 11:
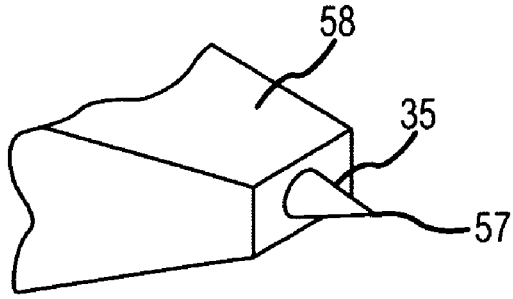
FIG. 11 shows a particular embodiment of an insulator coupled to one of a pair of conductors and a particular embodiment of a conductor end.

Now referring to FIGS. 9, 10, and 11, as to certain embodiments of the invention, each of the pair of conductor ends (35)(36) (although the Figures show only one conductor end (35) of the pair as examples) can be rectangular in cross section (see for example FIG. 9) or circular in cross section (see for example FIG. 10 and FIG. 11). These examples are not intended to be limiting with respect to the numerous and wide variety of cross sectional geometries that can be utilized with the invention and other cross sectional configurations that can include square, oval, triangular, hexagonal, or the like, depending on the application. The conductor terminal (57) of each conductor end (35)(36) (or additional conductor ends) can provide a rectangular surface (see example FIG. 7A) or circular surface (see example FIG. 7B), or other configuration of conductor terminal (57) to provide a conductor terminal surface having an oval surface, a square surface, a triangular surface, a hexagonal surface, or like, depending upon the application. Additionally, the conductor ends can taper in one or more directions approaching the conductor terminal (57) to provide a terminal surface having a reduced surface area such as a lesser area of the cross sectional configuration, or an edge, a point, or the like. As shown by the non-liming example of FIG. 11, the conductor end (35) circular in cross section can conically taper to a point. Understandably, the conductor end (35) shown by FIG. 9 could also taper in one or both of the sides of lesser dimension (59)(60) to provide a conductor end (35) having a wedge shape or terminating in a trucated wedge having terminal edge.

Again referring to FIGS. 9, 10, and 11, as to certain embodiments of the invention, one or both of the pair of conductors (35)(36) or other pairs of conductors can further include an electrical insulator (58) of an electrically non-conductive material which surrounds one or both of the pair of conductors (35)(36) terminating a sufficient distance from the conductor ends (35)(36) to allow a discharge (31) of electrical current (30) (a spark) between the corresponding first conductor end (35)(46) and the second conductor end (36)(47) of a first pair of conductor ends (35)(36) or a second pair of conductor ends (36)(47). While the electrical insulator (58) shown in the Figures can be made from a ceramic; this is not intended to be limiting with respect to the wide variety of electrical insulating materials that can be utilized in embodiments of the invention.

Now referring specifically to FIGS. 9 and 10, the electrical insulator (58) can be rectangular in cross section as shown in FIG. 9, circular in cross section as shown in FIG. 11, and without limitation, square, triangular, oval, or the like in cross section, depending upon the application. Additionally, the electrical insulator (58) can taper approaching the conductor end (35). As shown in the non-limiting example of FIG. 9 as an example, a pair of insulator sides (61)(62) can be configured as triangles or truncated triangles disposed in opposed relation to define a corresponding pair of square, rectangular, or trapezoid faces (63)(64) (also referred to as "wedge shaped") (see for example the face (63) in broken line). The configuration of the electrical insulator (58) when contacted with the fuel in a fuel dispersion pattern (38) can generate turbulence in the fuel dispersion pattern (38) proximate the gap (32) between the pair of conductors (35)(36) (or other pairs of conductors) which can significantly increase efficiency in fuel ignition upon a discharge (31) of electrical current (30)(spark) across the gap (32). While the wedge shaped insulator above-described provides significant advantageous turbulence in the fuel dispersion patterns (38) which can be fluidicly coupled with the various embodiments of the gap (32) defined by location of the pairs of conductor ends (35)(36) or (46)(47) above-described, it is not intended that this configuration of electrical insulator (58) be limiting with respect to the numerous and varied configurations of the electrical insulator (58) which can be used with the invention, such as the conically tapered electrical insulator (58) shown for example in FIG. 10.

EXAMPLES

Twenty seven ignition tests were performed each test consisting of a specific conductor configuration including, but not limited to, the above-described embodiments of the invention. As to each test of a specific conductor configuration, the pair of conductor ends were disposed in a fixed relation to the nozzle orifice of the fuel injector as fuel was emitted from the nozzle orifice with the fuel disperson pattern substantially the same between tests. Each test included approximately 43 trials each trial including a discharge (spark) between the pair of conductor ends with even polarity change. Each discharge and the resulting level of fuel ignition was video recorded. The interval between trials in each test was sufficient to allow recovery of the fuel dispersion pattern prior to the next discharge of the electrical current between the pair or multiple pairs of conductors. The video recordings were analyzed for fuel ignition and fuel ignition characteristics.

Configurations of the conductor pairs in which each conductor end has a location substantially the same distance from the nozzle orifice and radially spaced a distance apart about the longitudinal axis of the nozzle (as shown for example by FIGS. 5A and 5B) had an ignition success rate in a range of 28% to 97% with the highest percentage ignition success rate at the fuel dispersion boundary (for example as shown in FIGS. 5A and 5B) and decreasing as the location of the pair of conductor ends were disposed a greater or lesser distance radially from the fuel dispersion boundary. The lowest percentage fuel ignition success occurring with the pair of conductor ends disposed within the fuel injection pattern proximate the longitudinal axis of the nozzle.

Configurations of the conductor pairs which locate a first conductor end or a second conductor end at a greater distance from the nozzle orifice whether radially aligned (as shown for example in FIGS. 8A and 8B) or radially spaced a distance apart about the longitudinal axis (as shown for example in FIGS. 7A and 7B) substantially increased ignition success rates regardless as to whether the conductor pair was discharged within the fuel dispersion pattern or discharged at the fuel dispersion pattern boundary. Specifically, with respect to configurations of the conductor pairs which locate the first conductor end and the second conductor end similar to that shown in FIGS. 8A and 8B with the first conductor end radially aligned with the second conductor end (one above the other) ignition success was 100% for all zones within the fuel injection pattern and at the fuel injection pattern boundary.

The tests show that configurations of the conductor pairs which locate the conductor ends at different distances from the nozzle orifice (as shown for example by FIGS. 7A and 7B and 8A and 8B) substantially and unexpectedly increase the fuel ignition success rates in all zones of the fuel dispersion pattern and at the fuel dispersion pattern boundary as compared for the same zones with configurations of the conductor pairs which locate the conductor ends at the same distance from the nozzle orifice (as shown for example by FIGS. 5A and 5B or 6A and 6B).

As can be easily understood from the foregoing, the basic concepts of the present invention may be embodied in a variety of ways. The invention involves numerous and varied embodiments of a multiple electrode spark gap fuel injection system which provides at least one pair of electrodes having corresponding pair of electrode ends radially and axially located in relation to an amount of dispersed fuel to increase efficiency of fuel combustion upon discharge of an electrical current across a gap and methods of using such multiple electrode spark gap fuel injection system.

As such, the particular embodiments or elements of the invention disclosed by the description or shown in the figures accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

Additionally, for the purposes of the present invention, ranges may be expressed herein as from "about" one particular value to "about" another particular value. When such a range is expressed, another embodiment includes from the one particular value to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint. The term "about" has the ordinary meaning of "approximately" in the absence of a clear expression and description to the contrary.

Moreover, for the purposes of the present invention, the term "a" or "an" entity refers to one or more of that entity; for example, "a pair of conductors" refers to one or more pairs of conductors. As such, the terms "a" or "an", "one or more" and "at least one" can be used interchangeably herein.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "injector" should be understood to encompass disclosure of the act of "injecting"—whether explicitly discussed or not—and, conversely, the disclosure of the act of "injecting", should be understood to encompass disclosure of an "injector" and even a "means for injecting." Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

Thus, the applicant(s) should be understood to claim at least: i) each of the fuel injectors herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The claims set forth in this specification are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth below are intended describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

I claim:

1. A fuel injector, comprising:

a) a fuel injector body;

b) a nozzle coupled to said fuel injector body said nozzle having at least one nozzle orifice, said nozzle having a longitudinal axis; and c) a pair of conductors which terminate a distance radially outward from said nozzle orifice in a corresponding pair of conductor ends disposed to allow a discharge of an electrical current across a gap, and wherein a first one of said pair of conductor ends and a second one of said pair of conductor ends axially locate an unequal distance along said longitudinal axis.

2. The fuel injector of claim 1, wherein said first one of said pair of conductor ends and said second one of said pair of conductor ends radially align about said longitudinal axis at about equal distance outward from said longitudinal axis.

3. The fuel injector of claims 2, wherein said first one of said pair of conductor ends and said second one of said pair of conductor ends radially locate a distance apart about said longitudinal axis at about equal distance outward from said longitudinal axis.

4. The fuel injector of claims 2, wherein said first one of said pair of conductor ends and said second one of said pair of conductor ends radially locate an unequal distance outward from said longitudinal axis.

5. The fuel injector of claim 1, wherein said pair of conductor ends comprises a first pair of conductor ends, and further comprising a second pair of conductors which terminate a distance from said nozzle orifice in a corresponding second pair of conductor ends disposed to allow a discharge of an electrical current across a gap.

6. The fuel injector of claim 5, wherein said first pair of conductor ends and said second pair of conductor ends radially locate in substantially opposed relation about 180 degrees apart about said longitudinal axis of said nozzle.

7. The fuel injector of claim 5, wherein said first one of said second pair of conductor ends and said second one of said second pair of conductor ends axially locate at unequal distance along said longitudinal axis and radially align about said longitudinal axis at about equal distance outward from said longitudinal axis.

8. The fuel injector of claim 5, wherein said first one of said pair of conductor ends and said second one of said pair of conductor ends of each of said first pair of conductor ends and said second pair of conductor ends radially locate an unequal distance outward from said longitudinal axis.

9. The fuel injector of any one of claims 1, further comprising an amount of fuel dispersed through said nozzle orifice said amount of fuel having a fuel dispersion pattern which defines a fuel dispersion boundary.

10. The fuel injector of claim 4, wherein said first conductor end and said second conductor end has a location outward from said longitudinal axis proximate said fuel dispersion boundary.

11. The fuel injector of claim 5, further comprising an amount of fuel dispersed through said nozzle orifice said amount of fuel having a fuel dispersion pattern which defines a fuel dispersion boundary.

12. The fuel injector of claim 8, wherein each said first conductor end and each said second conductor end has a location outward from said longitudinal axis proximate said fuel dispersion boundary.

* * * * *